United States Patent [19]

Hirozawa

[11] 4,406,617

[45] Sep. 27, 1983

[54] PRE-MIXING TYPE BURNER

[75] Inventor: Yasuo Hirozawa, Iwakuni, Japan

[73] Assignee: Hitachi, Ltd., Tokyo, Japan

[21] Appl. No.: 212,706

[22] PCT Filed: Feb. 28, 1980

[86] PCT No.: PCT/JP80/00034

§ 371 Date: Nov. 6, 1980

§ 102(e) Date: Nov. 6, 1980

[87] PCT Pub. No.: WO80/01945

PCT Pub. Date: Sep. 18, 1980

[30] Foreign Application Priority Data

Mar. 7, 1979 [JP] Japan ..... 54-25522

[51] Int. Cl.[3] ..... F23D 15/00

[52] U.S. Cl. ..... 431/351; 431/8; 431/114

[58] Field of Search ..... 431/8, 10, 208, 349, 431/351, 114

[56] References Cited

U.S. PATENT DOCUMENTS 3,304,986 2/1967 Zwaagstra et al. ..... 431/349

4,175,919 11/1979 Matsumoto et al. ..... 431/351 X

FOREIGN PATENT DOCUMENTS 769484 10/1967 Canada ..... 431/349

53-109836 9/1978 Japan .

*Primary Examiner*—Samuel Scott

*Assistant Examiner*—Margaret A. Focarino

*Attorney, Agent, or Firm*—Antonelli, Terry & Wands

[57] ABSTRACT

This invention relates to a pre-mixing type burner suitable for use as a heat source for hot water heater or hot air heater. Conventional premixing type burner of this kind has a flame port section (4) having a multiplicity of slit-like flame ports (5) arranged at a right angle to the wall of a combustion chamber. The flame port (4) has a greater thickness at the central portion than at the end portions and is provided with a flat flame port surface. A passage (2) for supplying secondary air is provided at the central part of the flame port section. This conventional arrangement suffers a disadvantageous poor ignition or generation of resonance noise. If the burner is so designed that a small attached flame is formed at the flame port (5), ignition is improved but resonance noise is produced, and vice versa. The invention was made in view of the problem discussed. Namely, the invention provides a projection (41) on the portion of the flame port surface adjacent to the combustion chamber wall (15) such that, between the projection (41) and the combustion chamber wall (15), there is formed a gap (42) which constitutes a flame port. An attached flame is formed at the portion of the flame port (5) except the portion where the gap (42) is formed, thereby to improve the ignition, while a flame (preferably, a large one) which functions to prevent the perturbation of the attached flame is formed at the gap (42) thereby to prevent the generation of the resonance noise.

6 Claims, 7 Drawing Figures

PRE-MIXING TYPE BURNER

TECHNICAL FIELD

The present invention relates to a pre-mixing type burner suitable for use as the heat source of hot water heater or hot air heater.

BACKGROUND ART

The invention is concerned with a pre-mixing type burner having a multiplicity of slit-like flame ports which are arranged in juxtaposed relationship with each other and at a right angle to the walls of the combustion chamber with one end of each flame port being in contact with the wall and, more particularly, to a pre-mixing type burner having a comparatively large combustion chamber load of the order of $10^7$ Kcal/h·m$^3$.

The conventional burner of the type stated above will be described hereinafter with specific reference to FIGS. 1 to 3. The description will be made, by way of example, on an assumption that the vapor of a liquid fuel (kerosene) is used as the fuel and that the burning flame is directed downward.

The reference numeral 1 denotes a burner element disposed linearly. The burner element 1 is provided at its inner central portion with a secondary air passage 2. A multiplicity of secondary air ports 3 in the form of parallel slits are formed in the projected part of the burner element 1. The reference numeral 4 denotes a flame port section provided at both sides of the secondary air passage, and provided with a multiplicity of slit-like flame ports 5. The flame port section 4 has a greater thickness at its central portion than at its outer portions. The burner element 1 is made from an extruded aluminum material. The secondary air ports 3 and flame ports 5 are formed by slotting the end of the extruded blank material by means of a slotting milling machine or the like. The flame ports 5 open also in the burner supporting portion 6 formed at the end of the flame port section 4. The secondary air ports 3 and the flame ports 5 extend at a right angle to the wall of the combustion chamber.

The reference numeral 10 denotes an evaporator for liquid fuel which is integrally attached by welding or the like measure to the burner element 1. The evaporator 10 is provided with an electric heater 11. A liquid fuel and primary air flow into the passage 12. An outlet port for pre-mixed admixture gas is designated by reference numeral 13.

Left and right combustion chamber walls 15, formed of die-cast aluminum and arranged in pair, cooperate with each other to define therebetween a combustion chamber 16 and a passage 17 for the pre-mixed gaseous admixture. The aforementioned supporting portion 6 of the burner element 1 is received by a groove 18. Combustion chamber walls 15, 15 are integrally welded to each other. The combustion chamber 16 has a slightly diverging form with a convection type heat exchanger disposed at the diverged end thereof.

The burner element 1 is closed at its one end by a closure plate 20 which is fastened to the burner element 1 by means of screws 22, with a packing 21 interposed therebetween. This assembly is inserted into the pre-mixed gas passage 17 through a packing 23 and is fixed to the combustion chamber wall 15 by means of screws 24. Reference numerals 25 and 26 denote, respectively, a secondary air inlet port and an inlet port for the primary air and liquid fuel.

The reference numeral 27 denotes a closure plate for closing the other end of the burner element 1, the plate being fixed to the latter by means of screws 29 with a packing 28 interposed therebetween. The combustion chamber 16 and the pre-mixed gas passage 17 are closed by a closure plate 30 which is fixed to the combustion chamber wall 15 by means of screws 32.

The reference numeral 33 denotes a cover for covering the portion of the combustion chamber wall 15 defining the pre-mixed gas passage 17. This cover 33 is inserted into grooves 34 and 35 formed in the closure plates 20 and 27. In order to avoid the condensation of the liquid fuel at the time of ignition, the cover 33 is heated by an evaporator 10 through the medium of closure plates 20 and 27.

The reference numeral 36 designates an ignition electrode.

In operation, when the electric power is supplied to the electric heater 11 and the evaporator 10 is heated up to a predetermined temperature, e.g., 250° C., and the supply of air is started by a blower. On the other hand, a liquid fuel is supplied into the passage 12 of the evaporator 10 and is evaporated so as to be mixed with primary air to form a pre-mixed gaseous mixture. The pre-mixed gaseous mixture then flows through the outlet port 13 into the pre-mixed gas passage 17 and is discharged from the latter through the flame ports 5 of the flame port section 4. The discharged pre-mixed gaseous mixture is then ignited by means of the ignition electrode 36 to form a primary flame and is completely burnt with the aid of secondary air introduced through the secondary air port 3.

As the combustion is commenced, the heat of combustion is transmitted through the burner element 1 to the evaporator 10 and then the supply of electric power to the electric heater 11 of the evaporator 10 is stopped.

Since the flame port section 4 has a smaller thickness at its portion closer to the combustion chamber wall 15 than at its portion remote from the same, the flow velocity and flow rate of the pre-mixed gaseous admixture are greater in the region closer to the combustion chamber wall 15 than in the region remote from the same. In other words, the load imposed on the flame ports is greater in the area closer to the combustion chamber wall 15 than in the area remote from the same. Namely, the primary flame formed in the region remote from the combustion chamber wall 15 is a small stable attached flame, while the primary flame formed in the region near the combustion chamber wall 15 is a somewhat lifted flame and the flame adjacent to the combustion chamber wall 15 is formed therealong. Therefore, each slit of the flame port 5 forms a flame shape represented by $F_2$ in FIG. 4. This flame is a primary flame.

The large flame near to the combustion chamber wall 15 and the stable small flame near to the secondary air port 3 in combination provide a stable burning. This conventional burner, however, suffers the following drawbacks. Namely, when the burner is operated with the heat input of, for example, 17,000 Kcal/h, the ignition is difficult or, alternatively, a resonance sound is generated, for the reason discussed hereinunder.

The aforementioned flame $F_2$ is formed in the steady state of the burner operation, while, immediately after the ignition at which the temperature is still low, the flame takes a form shown by $F_1$. As the burner operation proceeds to the steady state, the combustion chamber wall 15 and the burner element 1 are heated by the flame and become effective to heat the pre-mixed gaseous admixture to increase the burning velocity, so that the flame comes to take the form $F_2$. Namely, the flame surface is shifted at the time of ignition.

It is considered that, since the thickness of the burner supporting portion 6 is smaller than that of the flame port section 4 and since there is a gap 40 between the flame port surface and the groove 18, there is a flow component A of the pre-mixed gas passing from the supporting portion 6 through the gap 40. Therefore, it is believed that the load of the flame adjacent to the combustion chamber wall 15 exceeds the load predetermined on the basis of the thickness of the flame port section 4.

For these reasons, the ignition is somewhat difficult even when the fuel is a town gas if the burning velocity of the gas is of a small value. Furthermore, in a burner which utilizes vapor evaporated from a liquid fuel, the burning velocity is further reduced because the temperature of the pre-mixed gaseous mixture is lowered so as to lower the evaporation temperature for shortening the pre-heating time of the evaporator 10 and the burner element 1 at the starting of the burning. Also, there is a problem that the density of the initial pre-mixed gaseous mixture is low because of the delay of operation of the liquid fuel supply system and/or the delay of evaporation. For these reasons, the ignition is difficult or the flame is undesirably blown out.

It has been found that the above-described problems of the prior art can be overcome by eliminating the flow component A and improving the attachment of the flame to the flame port surface. This can be achieved by, for example, making the open end of the groove 18 contact with the flame port surface to eliminate the gap 40 and to form a flame as shown by $F_3$.

It is considered that the whole part of the flame $F_3$ in this state is a perfect laminar-flow attached flame. This flame, however, is liable to be effected by external disturbances and perturbed to generate unpleasant noise (referred to as "resonance noise") as a result of resonance of the frequency of the perturbed combustion with the proper frequency of the whole of the burner.

The improvement in the ignitability and the elimination of the resonance are incompatible with each other.

In addition, if the load on the flame ports is lowered, the flame becomes to be of the form as shown by $F_3$, the ignitability is rendered poor and resonance noise is generated.

DISCLOSURE OF THE INVENTION

In a burner having such a construction as discussed above, the present invention provides projection on the portion of the flame port surface of the flame port section adjacent to the combustion chamber wall to form a gap between the combustion chamber wall and the end of the projection so that an attached flame is formed over substantially the entire part of the flame port section except the portion where the gap is formed, thereby to improve the ignitability and so that a flame is formed in the aforementioned gap to prevent the attached flame from being perturbed for thereby avoiding the generation of the resonance noise.

BEST MODE FOR CARRYING OUT THE INVENTION

Figure 1:
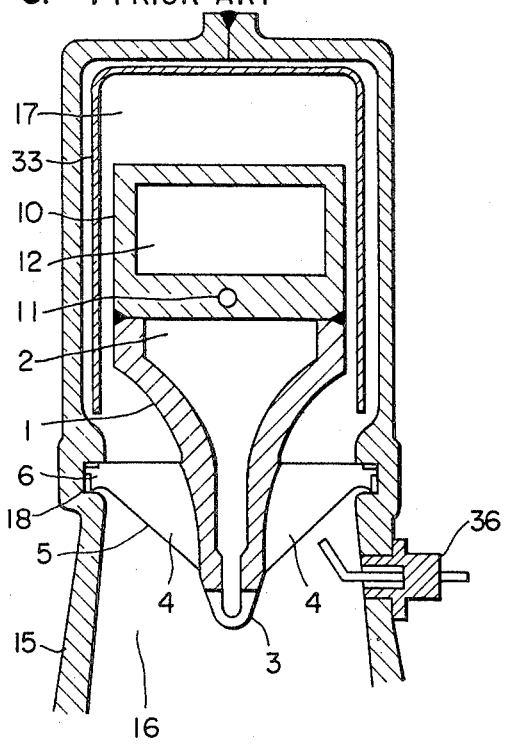
FIG. 1 PRIOR ART
FIG. 1 is a vertical sectional view of the conventional pre-mixing type burner.
Figure 3:
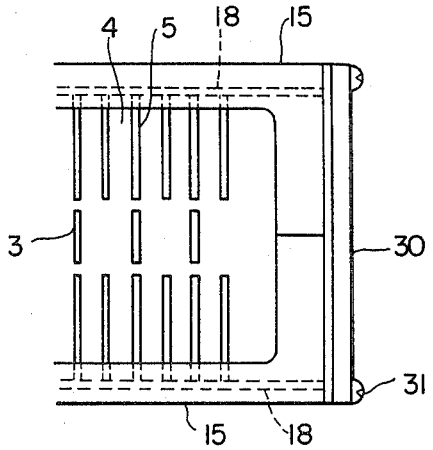
FIG. 3 PRIOR ART
FIG. 3 is a bottom plan view of the right end portion of the burner shown in FIG. 2.
Figure 2:
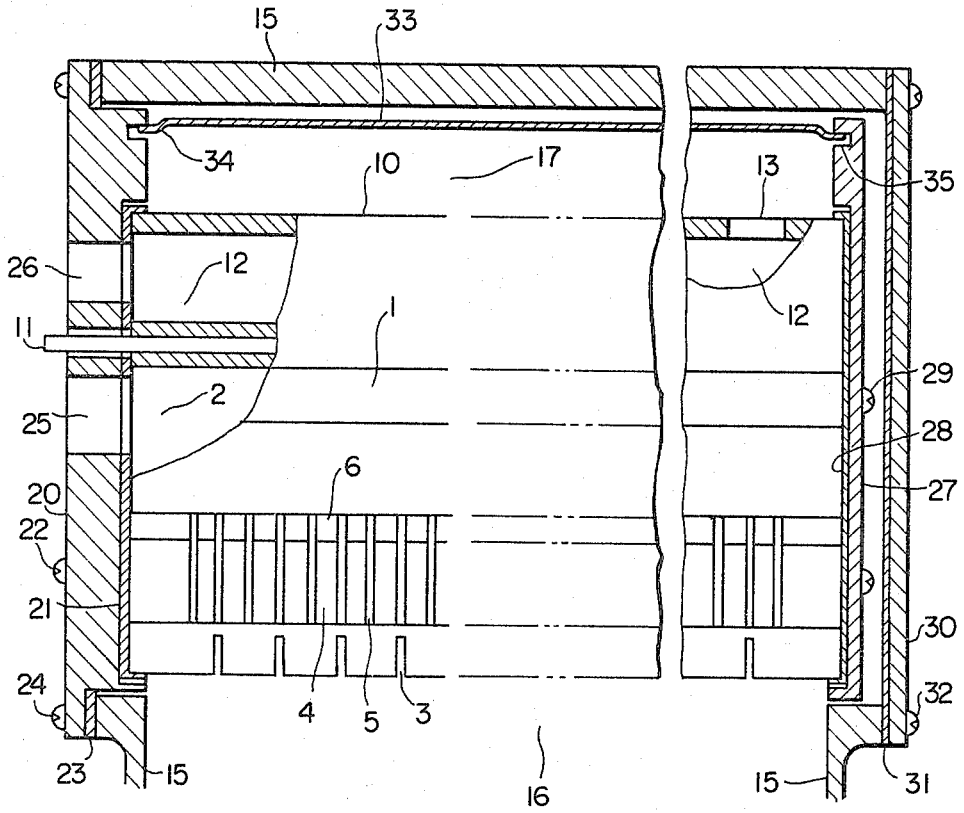
FIG. 2 PRIOR ART
FIG. 2 is a cross-sectional view of the burner shown in FIG. 1 taken substantially at the central portion thereof.
Figure 4:
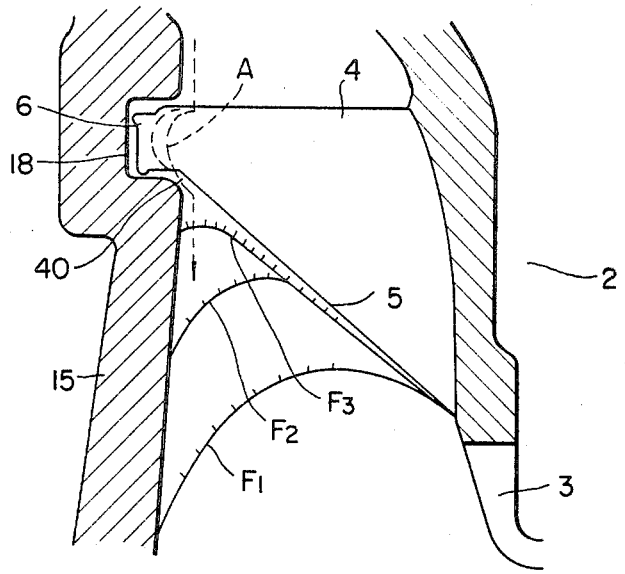
FIG. 4 PRIOR ART
FIG. 4 is an enlarged vertical sectional view of a portion of the burner shown in FIG. 1 around a flame port section.

The invention will be described by way of example with reference to FIG. 5. The reference numeral 41 denotes a projection extending from the end of the flame port section 4 adjacent to the combustion chamber wall 15. The projection 41 extends a distance h from the supporting portion 6 to form a gap 42 between the end of the projection 41 and the combustion chamber wall 15. The end of the projection 41 is smoothly connected as illustrated to the conventional flame port surface. The flame port 5 is provided also in this projection 41.

According to this arrangement, the influence, on the flame, of the flow component A of the pre-mixed gaseous mixture adjacent to the supporting portion 6, is made smaller than that in the conventional burner due to the flow resistance by the height h of the projection 41 and the dimension d of the gap 42. Therefore, the flame formed on the most part of the flame port 5 except the gap 42 is an attached flame as represented by $F_4$. Thus, the flame as a whole exhibits a good attaching characteristic, so that a flame which is substantially similar to that formed in the steady state is obtained at the time of start up of the burner, whereby the ignitability is improved.

On the other hand, a flame $F_5$ is formed at each flame port constituted by the gap 42. Provided that the size d of the gap 42 is properly determined, the flame $F_5$ functions to prevent the perturbation of the flame $F_4$ and, hence, the generation of the resonance noise.

An explanation will be given below with respect to the prevention of the resonance noise.

An example will be given hereunder.

Depth of groove 18: 4.5 mm, Height of groove: 6 mm, Distance l between combustion chamber wall 15 and end of flame port 5 adjacent to secondary air port 3: 23 mm, Maximum wall thickness of flame port section 4: 26 mm, Minimum wall thickness of flame port section 4: 4.5 mm, Slit width of flame port: 0.9 mm, Pitch of flame ports 5: 2.6 mm, Width of combustion chamber 16 near to supporting portion 6: 60 mm, Length of combustion chamber: 280 mm, Rated heat input: approximately 17,000 Kcal/h, Mean flame port load: approximately 3.3 $Kcal/mm^2 \cdot h$, Combustion chamber load: approximately $1.67 \times 10^7$ $Kcal/h \cdot m^3$, Excess air ratio: 1.6, Fuel used: vapor of kerosene.

With the example given above and with the projection 41 having a height h of 7 mm and with the gap 42 having a dimension d of 2 mm, flames obtained were of the shapes shown by $F_4$ and $F_5$. In addition, improvement in ignitability and prevention of resonance noise were attained within the range of ±10% of the heat input.

The height of the flame $F_4$ was approximately 1 mm. The flame $F_5$ was as large as the size shown and apparently observed to be mainly formed at the opening formed by cutting the flame port 5. The flame $F_5$ was continuous to the flame $F_4$. A test showed that the flame $F_4$ varied a little from the moment when the initial ignition was made to the time when a steady state was obtained, whereas the flame $F_5$ was varied between these two times.

When the size d of the gap 42 in the tested burner was reduced to 1 mm, the size of the flame formed at the gap 42 was almost equal to the of the flame $F_4$. In this state, the whole part of the flame was attached flame and a resonance noise was generated. The flame was completely received in the gap 42 when the size d was increased to 3 mm. An improvement in the ignitability and prevention of resonance noise were effectively achieved in this case. In this case, however, the state of the flame $F_5$ could not be visually checked because the flame was accomodated by the recess.

From these facts, it is considered that the prevention of perturbation of the flame $F_4$ is attributable to the stable and strong flame formed at the flame port 42 which interconnects the adjacent flame ports 5—5. When the size d of the gap 42 which constitutes the flame port is selected to be 1 mm, which approximates the flame-extinction distance in the case of the use of kerosene as the fuel, the gap 42 cannot form a flame port which interconnects the adjacent flame ports. Thus, the generation of the resonance noise cannot be prevented. Even in this case, however, there neverthless is a possibility of prevention of the resonance noise by selecting smaller pitches of the flame ports.

Although the gap 42 has been described as constituting a flame port which interconnects the flame ports 5—5, it is not essential that apparently a flame is formed which interconnects the flame ports 5—5, as will be realized from the example in which the size d is equal to 2 mm.

Sinking of the flame into the gap 42 will incur a danger of flashback.

Figure 6:
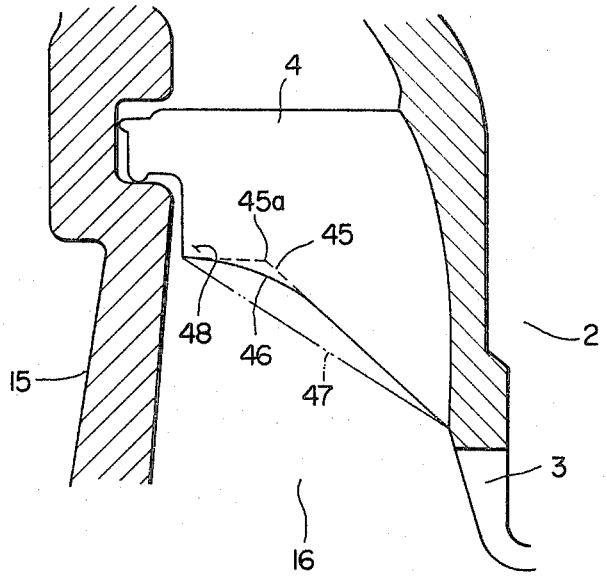
FIG. 6 is an illustation of the shape of the flame port surface in the burner of the invention.

FIG. 6 illustrates the configuration of the flame port surface. If the flame port surface is shaped as shown by straight lines 45, a discontinuity of flow is formed at the point 45*a* of discontinuity of the lines 45. Thus, the flame is undesirably disturbed to generate a burning noise. It is, therefore, preferred to employ a smoothly continuous curve 46. A straight line 47 may alternatively be employed. It is also possible to make the passage diverge as shown by a line 48. A stepped shape may also be utilized.

Figure 7:
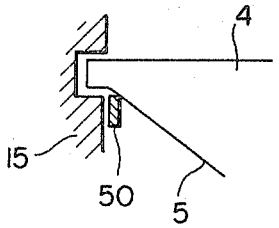
FIG. 7 is an enlarged vertical sectional view of a portion of a pre-mixing type burner in accordance with another embodiment of the invention, showing particularly a portion around the flame port section.

FIG. 7 shows another embodiment of the invention in which the projection 41 is replaced by a separate plate member 50 fixed to the flame port surface. The projecting plate 50 is disposed at the flame ports 5 and extends in the longitudinal direction of the burner. The size of the burner supporting portion and other portions are identical to those shown in FIG. 1. It has been found that this embodiment provides similar advantageous results. A modification in which the projection 50 is formed integrally with the flame port section 4 and in which the flame ports 5 are formed by cutting was thought of, but it has been found that this modification is not preferable.

Figure 5:
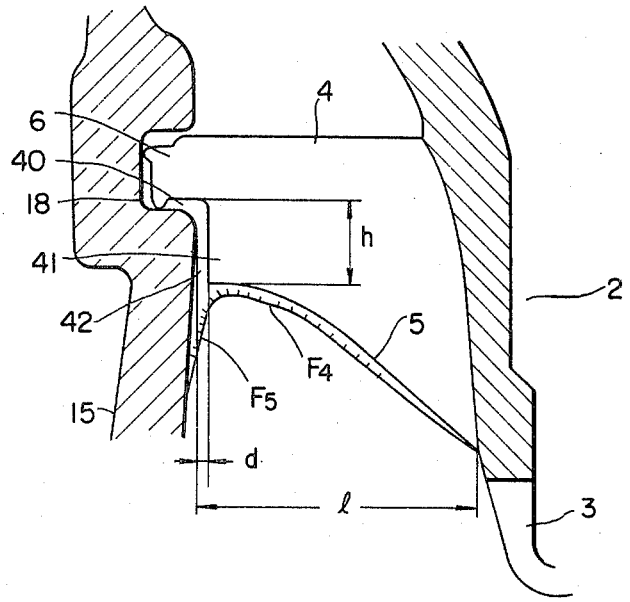
FIG. 5 is an enlarged vertical sectional view of a portion of a pre-mixing type burner in accordance with an embodiment of the invention, showing particularly the portion around the flame port section.

In the embodiment shown in FIG. 5, the gap 40 is not essential and can be eliminated. Although the thickness of the flame port section 4 adjacent to the combustion chamber walls 15 is different from the thickness of the port section 4 adjacent to the secondary air port 3, it is thought that the flame port section 3 can have a uniform thickness.

It is also to be noted that the invention can be applied to burners designed for use with town gas. The invention may also be applied to burners in which flames are upwardly directed.

I claim:

1. A pre-mixing type burner having a flame port section with a multiplicity of slit-like flame ports, said flame ports being arranged in juxtaposed relationship with each other and at right angles to the wall of a combustion chamber, the ends of said flame ports adjacent to said combustion chamber wall being covered, characterized by a projection extending along said combustion chamber wall and projecting into said combustion chamber from the portion of the flame port surface of said flame port section adjacent to said combustion chamber wall in such a manner as to define a gap with said combustion chamber wall, the portion of said flame port section defining said flame ports except said gap having such a thickness that, for a flame port load, an attached flame is formed.

2. A pre-mixing type burner as claimed in claim 1, wherein the thickness of said flame port member including said projection, as measured from the inlet side of the pre-mixed gaseous admixture to said flame port surface, is such that the thickness of the portion to the end of said projection is greater than the covered portion but smaller than the thickness of the portion of said flame port section where said attached flame is formed, the flame port surface at the portion of said flame port section where said attached flame is formed extending toward said combustion chamber beyond said projection, said projection and said portion where said attached flame is formed being provided on a line having no discontinuity, said flame port being also formed at said projection.

3. A pre-mixing type burner as claimed in claim 1, wherein said gap is greater than the flame-extinction distance peculiar to the fuel used.

4. A pre-mixing type burner as claimed in claim 2, wherein said gap is so sized as to form a flame greater than that formed at said flame port.

5. A pre-mixing burner including an enclosure, a burner element disposed in said enclosure substantially centrally thereof and defining a secondary air passage and a row of secondary air ports communicated therewith, flame port sections disposed on the opposite sides of a central section of the burner element defining the secondary air passage and extending outwardly therefrom across the interior of said enclosure to the opposite inner surfaces thereof to cooperate with said central section and with a part of said enclosure to define a combustion chamber communicated with said secondary air passage said secondary air ports, each flame port section being formed therein with substantially parallel slit-like flame ports each extending from the outer end of said flame port section towards said central section, the part of said enclosure which faces said combustion chamber forming combustion chamber walls, the rest of said enclosure defining therein a passage for a pre-mixed combustible gas flowing therefrom through said flame ports into said combustion chamber, the thickness of each flame port section as measured in the direction of the flow of said pre-mixed gas decreasing from the inner end of said flame port section adjacent to said central section towards the outer end of said flame port section, each flame port section being arranged such that its inner end is offset from its outer end into said combustion chamber, the outer end of each flame port section being engaged with a groove formed in an associated inner surface of said enclosure, each flame port section being shaped to provide a projection disposed inwardly of the groove-engaging outer end of said flame port section and extending a distance into said combustion chamber, said projection cooperating with an associated combustion chamber wall to define a gap therebetween, and the surface of each flame port section directed to said combustion chamber being smoothly continuous from the inner end of said flame port section to said gap.

6. A pre-mixing type burner as claimed in claim 5, wherein said gap is so sized, in use of the burner, to form a flame greater than that formed at an adjacent flame port.

* * * * *